United States Patent [19]

Gunther, Jr. et al.

[11] Patent Number: 4,652,177

[45] Date of Patent: Mar. 24, 1987

[54] GUIDE TOWER MOUNTED CRANE FOR A JACK-UP PLATFORM

[75] Inventors: Albert W. Gunther, Jr., New Orleans; Albert W. Gunther, Sr., Jefferson; Daniel J. Volion, Marrero, all of La.

[73] Assignee: Crown Point Industries, Inc., Harvey, La.

[21] Appl. No.: 868,187

[22] Filed: May 21, 1986

Related U.S. Application Data

[63] Continuation of Ser. No. 566,319, Dec. 28, 1983, abandoned.

[51] Int. Cl.[4] ..... E02B 17/08; B66C 23/52

[52] U.S. Cl. ..... 405/196; 212/192; 212/253

[58] Field of Search ..... 405/195–200; 212/190–194, 253, 247

[56] References Cited

U.S. PATENT DOCUMENTS 4,011,955 3/1977 Morrow ..... 212/292

4,417,664 11/1983 Gordon ..... 405/200 X 4,456,404 6/1984 Evans ..... 405/203 X

FOREIGN PATENT DOCUMENTS 34672 9/1981 European Pat. Off. ..... 405/195

OTHER PUBLICATIONS

Rotek Catalog "Large-Diameter Ball and Roller Bearings".

Sea King 1700 "Marine Crane", Marine Equipment Systems.

Catalog "Gulf Island I" Power Well Service.

Crown Point Industries "Series 500K" brochure.

Catalog Manitowoc Model 3900 "Liftcrane, Clamshell, Dragline, Hoe".

*Primary Examiner*—Dennis L. Taylor

*Assistant Examiner*—Nancy J. Stodola

*Attorney, Agent, or Firm*—Glaser, Griggs & Schwartz

[57] ABSTRACT

A new and improved crane adapted to be rotatably mounted about the guide tower of a vertically movable leg of an offshore jack-up platform.

9 Claims, 6 Drawing Figures

GUIDE TOWER MOUNTED CRANE FOR A JACK-UP PLATFORM

This is a continuation of co-pending application Ser. No. 566,319 filed on Dec. 28, 1983, abandoned.

BACKGROUND OF THE INVENTION

1. Field of the Invention

The present invention relates generally to offshore working platforms which are self-propelled or towed to a shallow water well site and can be jacked-up above the water surface for use in drilling and production activities, and more particularly to cranes used on such platforms.

2. Description of the Prior Art

Typically, self-elevating lift barges or other self-elevating or jack-up platforms are used in offshore shallow water drilling and production activities. These self-elevating platforms or rigs typically incorporate a deck-mounted crane. These cranes are essential to the operation of such vessels or platforms and often become more important to the end user of these boats or platforms than the boat or platform itself.

The cranes typically used on jack-up boats or platforms in the past have included hydraulic cranes employing a box boom and using hydraulic cylinders to lift the boom. These cranes are very popular due to their short swing radius. However, in the recent past jack-up boat and platform sizes have increased substantially resulting in an increased demand being placed on a deck mounted crane which frequently exceeds the lifting capabilities of a typical cylinder lift crane. Since cylinder lift cranes rely on the strength of the boom to suspend and support the load, the heavier the load, the stronger or heavier the crane boom must be to support it. The heavier crane booms create several problems for a jack-up boat or platform, the most significant of which is listing while the boat or platform is underway.

In order to economize on weight, the alternative to a cylinder lift crane has been a conventional lattice-type boom which is tip supported. Although the boom on tip supported cranes is much lighter, all lattice boom cranes suffer from a major drawback of a very large overhanging gantry which increases the swing radius thereby taking up valuable deck space.

In contrast to cylinder lift cranes, which can raise their boom to almost a vertical position thereby enabling a load to be placed only a few feet from the crane base on the deck, conventional lattice boom cranes are not capable of raising the boom to a near vertical position. Accordingly, a tip-supported lattice boom crane which is mounted on deck suffers from an additional drawback of not being able to turn a full 360° due to interference from the long, extended legs mounted on the periphery of the platform or deck of the jack-up boat.

SUMMARY OF THE INVENTION

A new and improved crane adapted to be rotatably mounted about the guide tower of a vertically movable leg of an offshore jack-up platform.

DETAILED DESCRIPTION OF THE PREFERRED EMBODIMENT

Figure 1:
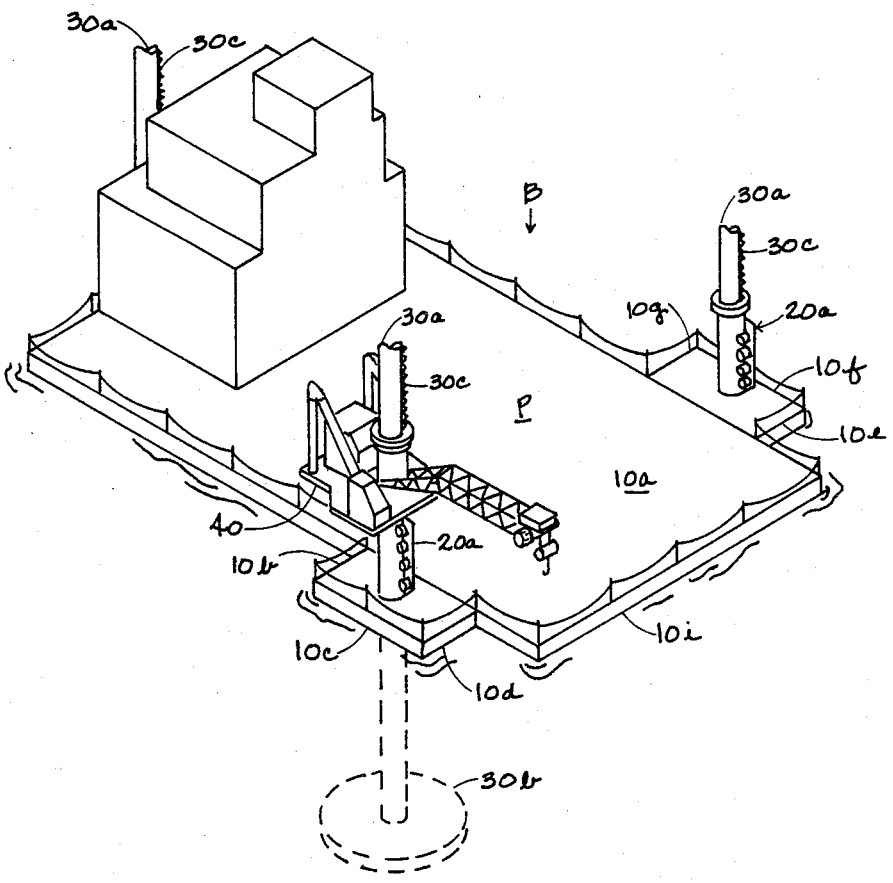
FIG. 1 is a schematic perspective of a jack-up boat showing the crane of the present invention mounted on the guide tower.

The platform P of the present invention may be part of a small offshort jack-up rig (not shown) or may be a jack-up boat B as shown in FIG. 1. It is understood that although the following detailed description will refer to a jack-up boat B having a deck or platform 10*a* any other platform which is designed for use in well operations in shallow offshore locations is within the field of the invention.

The jack-up boat B shown in FIG. 1 is self-propelled so that it may easily be maneuvered to any shallow water offshore location adjacent an oil and gas well. Having brought the jack-up boat adjacent an oil and gas well, it is necessary to stabilize the boat B by supporting it from the sea bottom rather than from the water surface.

Figure 6:
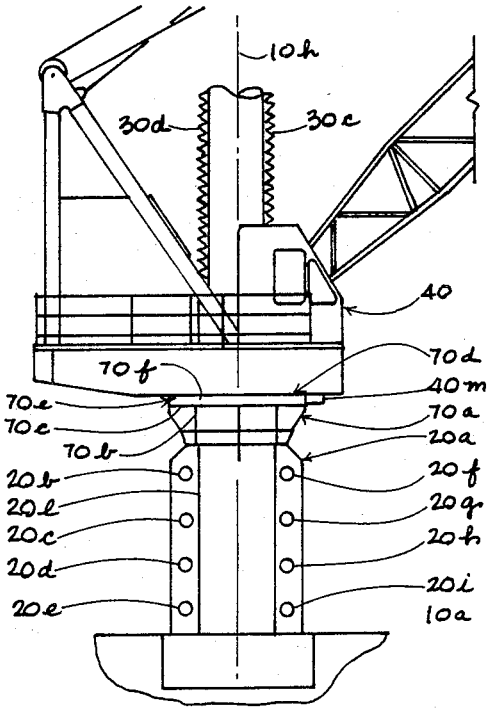

In order to shift the weight of the boat B to the subsea floor three guide towers 20*a* two of which can be seen in FIG. 1 are positioned around the periphery of the deck 10*a*. Typically the guide towers are mounted on deck extensions defined by surfaces 10*b*, 10*c* and 10*d* or surfaces 10*e*, 10*f* and 10*g* as shown in FIG. 1. As seen in FIG. 6 each guide tower 20*a* has a central axis perpendicular to deck 10*a*.

Guide towers 20*a* also have a central bore 201 (FIGS. 5 & 6) to accommodate a leg 30*a* which is slidably mounted through the central bore of the guide tower 20*a*. Each leg has a pad 30*b* connected to its base for the purposes of distributing the weight on each leg 30*a* along the sea floor. Each leg 30*a* includes two vertically mounted racks 30*c* and 30*d* positioned 180° apart on its outer periphery and designed to pass through the central bore 201 of guide tower 20*a* as leg 30*a* is raised or lowered relative to deck 10*a*.

Each guide tower 20*a* has a first vertical row of hydraulic motors 20*b*, 20*c*, 20*d* and 20*e* and a second row of hydraulic motors 20*f*, 20*g*, 20*h* and 20*i*. Each hydraulic motor 20*b* through 20*i* drives a pinion gear (not shown). The pinion gears are attached to hydraulic motors 20*b*, 20*c*, 20*d* and 20*e* are in contact with rack 30*d*. Similarly the pinion gears connected to hydraulic motors 20*f*, 20*g*, 20*h* and 20*i* are in contact with rack 30*c*. Accordingly, through the use of a hydraulic control system, of a type well known in the art, the pinion gears, attached to hydraulic motors 20*b* through 20*i* and meshing with racks 30*c* and 30*d*, can be used to drive each leg 30*a* up or down with respect to deck 10*a*. Therefore, in order to stabilize jack-up boat B on the sea floor, hydraulic motors 20*b* through 20*i* on each guide tower 20*a* are activated to drive each of legs 30*a* downwardly through the central bore of each guide tower 20*a* until pad 30*b* at the bottom of each leg 30*a* contacts the sea floor. It should be noted that although FIG. 1 illustrates the usage of three legs 30*a* with three corresponding guide towers 20*a*, designs incorporating the usage of additional legs 30*a* and guide towers 20*a* are within the purview of the invention. Similarly designs having more than two racks on a leg 30*a* with corresponding additional rows of hydraulic motors on a guide tower 20*a* are within the contemplation of the platform of the present invention.

As distinguished from jack-up boats in the prior art, which feature a deck mounted crane, the platform P of the present invention features a crane 40 supported on a guide tower 20*a*. The crane 40 shown in FIGS. 1–6 is a lattice boom tip supported crane. However, other types of cranes can be mounted to the guide tower 20*a* without departing from the spirit of the invention. Having the crane 40 mounted on a guide tower 20*a* frees up space on deck 10*a* adjacent front surface 10*i* of the jack-up boat B. Furthermore, when the crane 40 is mounted guide tower 20*a* it can easily rotate 360° as opposed to a deck mounted crane mounted adjacent to a guide tower 20*a* which may encounter interference with an adjacent leg 30*c* in any attempt to rotate 360°. Since the larger jackup-up boats B employ lattice boom tip supported cranes having an high capacity which further require a substantial turning circle, mounting the crane 40 on guide tower 20*a* frees up additional space on deck 10*a* which normally would have been consumed in providing turning clearance for the crane 40. Since the guide towers 20*a* with the crane 40 mounted thereon are disposed on extensions to deck 10*a* as indicated by surfaces 10*b*, 10*c* and 10*d* or 10*e*, 10*f* and 10*g* in FIG. 1, little, if any, valuable space on deck 10*a* is taken up by the turning clearance required for the crane 40.

Figure 3:
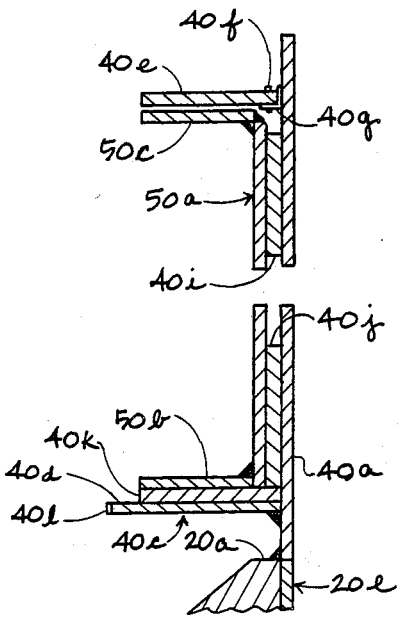
FIG. 3 is a sectional, elevational view of a king-post type crane mounting on a guide tower, taken along lines 3—3 of FIG. 2.
Figure 2:
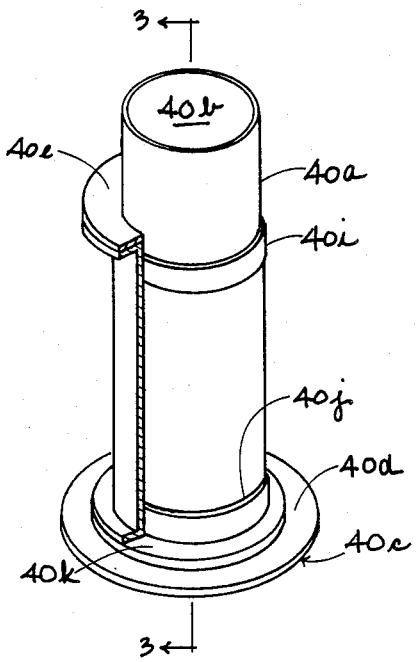
FIG. 2 is a schematic, perspective, sectional view of a tower section designed to be mounted above a guide tower, illustrating the placement of the bearing tube which supports the crane.
Figure 4:
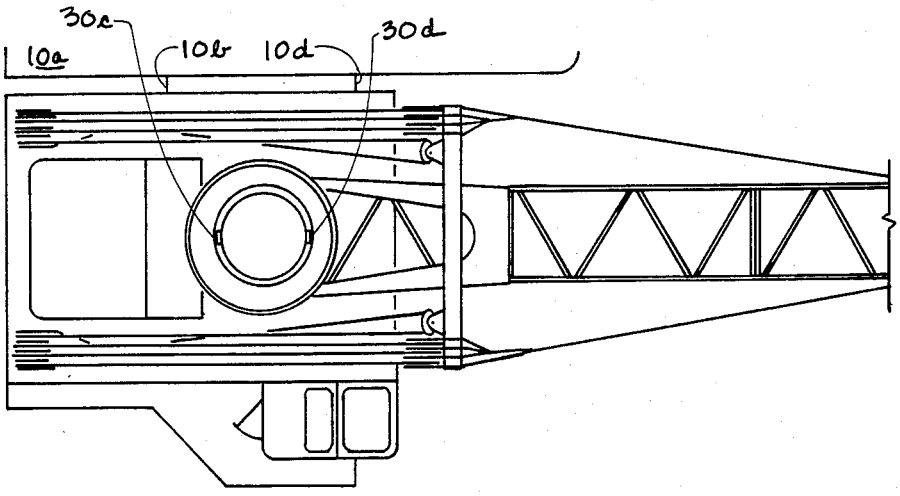
FIG. 4 is a plan view of the crane of the present invention mounted on a guide tower.
Figure 5:
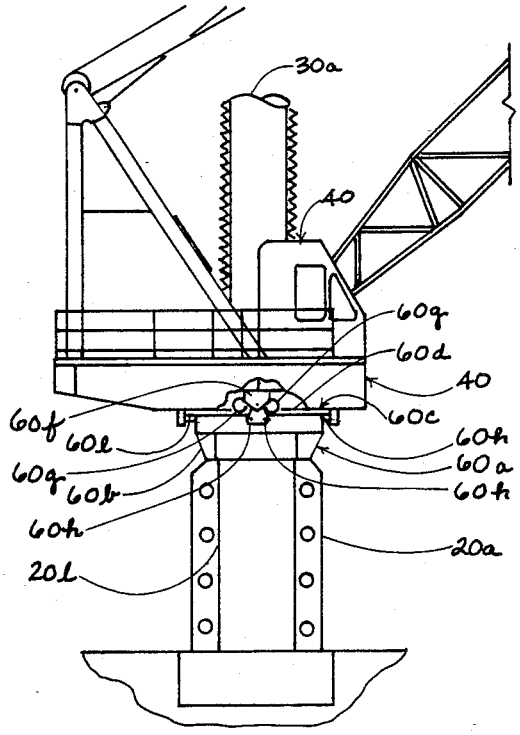
FIG. 5 is an elevational view showing the crane of the present invention mounted on top of the guide tower using hook rollers; and, FIG. 6 is an elevational view showing a crane mounted on top of a guide tower using a combination bearing.

There are several ways to attach the crane to the guide tower three of which are shown in FIGS. 2, 3, 5 and 6. FIGS. 2 and 3 relate to a king post type crane mounting system. FIG. 5 shows a hook roller mounting system. FIG. 6 illustrates a combination load bearing mounting assembly. Although these three types of mounting systems have been illustrated in the figures, different means to mount a crane 40 on a guide 20*a* can be used without departing from the spirit of the invention.

Referring to FIGS. 2 and 3 which illustrate the king-post method of mounting the crane 40 onto the guide tower 20*a*, a tower section 40*a* is attached to the upper end of a guide tower 20*a* above the hydraulic motors 20*b* through 20*i*. The tower section 40*a* is a tubular member which when placed above and attached to the guide tower 20*a* has a tower section central bore 40*b* in substantial alignment with the central bore 201 of guide tower 20*a* thereby allowing a leg 30*a* to travel up and down simultaneously, through tower section 40*a* and guide tower 20*a*.

Tower section 40*a* has a lower tower flange 40*c* with an upper surface 40*d* which acts as a bearing surface in supporting crane movement as will be more fully discussed hereinbelow. Upper surface 40*d* is essentially parallel to deck 10*a*. Upper tower flange 40*e* is disposed above lower tower flange 40*c*. Upper tower flange 40*e* is essentially parallel to lower tower flange 40*c* and is attached to tower section 40*a* via a series of bolts 40*f* which secure upper tower flange 40*e* to a mounting angle 40*g* which is in turn secured to tower section 40*a*. A resilient strip 40*i* is attached to tower section 40*a* slightly below upper tower flange 40*e*. A second resilient strip 40*j* is connected to tower section 40*a* adjacent lower tower flange 40*c*. A resilient thrust segment 40*k* extends from tower section 40*a* radially, between upper surface 40*d* of lower tower flange 40*c* and lower flange 50*b* of bearing tube 50*a*. The lower end of resilient strip 40*j* is adjacent to resilient thrust segment 40*k*.

Lower tower flange 40*c* can optionally have gear teeth 401 disposed along its outer periphery. When so equipped lower tower flange 40*c* functions as a stationary sprocket which can be used in rotating crane 40, mounted on bearing tube 50*a*, around the periphery of tower section 40*a*.

Bearing tube 50*a* has a lower flange 50*b* and an upper flange 50*c*. The upper flange 50*c* is assembled to bearing tube 50*a* after the crane 40 has been lowered onto lower flange 50*b*. Having lowered the crane onto lower flange 50*b* of bearing tube 50*a*, the upper flange 50*c* is then welded to bearing tube 50*a* so that it is essentially parallel to upper tower flange 40*e*. Having placed the crane 40 only lower flange 50*b* of bearing tube 50*a*, and secured the upper flange 50*c* to bearing tube 50*a*, upper tower flange 40*e* can be secured to tower section 40*a* via bolts 40*f* and mounting angle 40*g*. As can readily be seen from FIG. 3, resilient thrust segment 40*k* supports the bulk of weight of the crane 40 which is resting on top of lower flange 50*b* of bearing tube 50*a*. Furthermore, resilient strips 40*i* and 40*j* resist overturning moment from loads picked up by the crane 40 and permit bearing tube 50*a* to rotate about the outer periphery of tower section 40*a*. Similarly, resilient thrust segment 40*k* facilitates rotation of bearing tube 50*a* around the outer periphery of tower section 40*a*.

The king-post mounted crane 40 has an engine driven pinion 40*m* (an example of which can be seen in FIG. 6) which is horizontally disposed and engages the gear teeth 401 on lower tower flange 40*c*. Accordingly, by selectively driving engine driven pinion 40*m*, the crane nestled within bearing tube 50*a* can be made to rotate around the outer periphery of tower section 40*a*.

Referring to FIG. 5, the hook roller method of attaching the crane 40 to the guide tower 20*a* is illustrated. A mounting section 60*a* having a mounting section central bore 60*b* is connected to the top of guide tower 20*a*. The mounting section central bore 60*b* of mounting section 60*a* is in substantial alignment with the central bore 201 of guide tower 20*a* thereby enabling leg 30*a* to be driven vertically up or down simultaneously through both central bores 60*b* and 201. Mounting section 60*a* has a support flange 60*c* connected at the upper end of mounting section 60*a*. Support flange 60*c* has an upper bearing surface 60*d* and an lower bearing surface 60*e*. A plurality of roller assemblies 60*f* are attached to the underside of crane 40 at spaced intervals along a circular pattern. As shown in FIG. 5 the roller assemblies 60*f* are spaced at 90° intervals although different spacing may be employed depending upon the load characteristics of the particular crane 40 involved. Each roller assembly 60*f* has a series of upper rollers 60*g* which bear on upper bearing surface 60*d* and a series of hook rollers 60*h* which bear on lower bearing surface 60*e* of support flange 60*c*. Upper rollers 60*g* transfer the bulk of the weight of the crane 40 to the guide tower via upper bearing surface 60*d* of support flange 60*c*. Hook rollers 60*h* resist overturning moment placed on crane 40 due to loads picked up by the crane and the weight of the crane boom. The combination of upper rollers 60*g* and hook rollers 60*h* permits the crane 40 to rotate about the vertical axis of mounting section 60*a*. The crane 40 is rotated about the vertical axis of mounting section 60*a* due to the interaction of an engine driven pinion such as 40*m* (FIG. 6) or mounted to the crane and a stationary gear secured to or integral with the inside of mounting secton 60*a* just below support flange 60*c* (not shown).

FIG. 6 illustrates the combination bearing method of mounting the crane 40 to the guide tower 20*a*. A pedestal section 70*a* is mounted to the upper end of guide tower 20*a*. The pedestal section 70*a* has a pedestal section central bore 70*b* which is in substantial alignment with central bore 201 of guide tower of 20*a* thereby permitting leg 30*a* to move vertically up or down simultaneously through central bores 70*b* and 201. Pedestal section 70*a* has a mounting flange 70*c* at its upper end. Combination bearing 70*d* has a fixed segment 70*e* which is fixed to mounting flange 70*c*. Disposed within fixed segment 70*e* of combination bearing 70*d* is a rotating segment (not shown) which is adapted to be mounted to a mounting plate (not shown) on the base of crane 40. An engine driven pinion 40*m* is connected to crane 40 and meshes with gear teeth 70*f* located on the outer periphery of fixed segment 70*e*. Accordingly, the connection between the mounting plate (not shown) on the crane 40 and the rotating segment (not shown) of the combination bearing 70*d* enables crane 40 to rotate about central axis 10*h*. The position of the crane may be adjusted by selectively driving engine driven pinion 40*m* which due to its meshing with gear teeth 70*f*, selectively rotates crane 40 about central axis 10*h*.

By placing the crane 40 on a guide tower 20*a* additional load is placed on the guide tower which may tend to make the jack-up boat B list while underway. Accordingly, to offset the additional transfer of weight to the edge of the deck 10*a*, several pieces of on-board equipment such as water and oil storage tanks can be relocated to the opposite side of the jack-up boat B to counterbalance the additional load on the guide tower 20*a* which supports the crane 40.

As can readily be seen mounting the crane 40 on the guide tower 20*a* frees up additional space on deck 10*a* and eliminates the problem of leg interference in rotation of tip supported lattice boom deck mounted cranes. This is especially significant for jack-up boats B employing very large high-capacity cranes which have a tip supported boom as shown in FIGS. 5 and 6 as opposed to a hydraulically telescoping boom. Although the lower capacity cranes having a telescoping boom are able to raise the boom almost a vertical position, the heavier duty lattice boom tip supported cranes are not able to raise the boom to a vertical position. Accordingly, on the larger jack-up boats B employing a heavy duty tip supported crane, a deck mounted crane would be limited in rotation due to interference from an adjacent leg 30*a*. The platform of the present invention by mounting the crane 40 on a guide tower 20*a* has effectively solved the problem of interference with crane rotation posed by an adjacent leg 30*a*.

Accordingly, by mounting a tip supported lattice boom crane on a guide tower the problem of interference with an adjacent leg is eliminated. Furthermore, since the guide tower is located well above and off to the side of the deck (by virtue of its attachment to the top of the guide tower), no valuable deck space must be sacrificed in order to accommodate the large tail swing clearance normally required by such lattice boom tip supported cranes.

The foregoing disclosure and description of the invention are illustrative and explanatory thereof, and various changes in the size, shape and materials, as well as in the details of the illustrated construction may be made without departing from the spirit of the invention.

We claim:

1. Apparatus for mounting a crane to an offshore platform having guide towers carried by the platform and a plurality of legs, each slidably locatable in a bore in a respective one of the guide towers to support the platform form the sea bottom, comprising:

a tower section mounted on one of the guide towers and having a bore aligned with the guide tower bore to permit the respective guide tower leg to be slidably moved therethrough;

a tower flange attached to the tower section to form a bearing surface parallel to the platform;

a bearing tube disposed around the tower section for supporting the crane for rotation about the tower section;

a bearing tube flange attached to a lower end of the bearing tube parallel to the tower flange;

a resilient thrust segment between the tower and bearing tube flange to support the bulk of the weight of the crane and facilitate rotation of the bearing tube around the tower section; and, a pair of spaced-apart resilient strips surrounding the tower section to permit the bearing tube to rotate about the tower section to resist crane loads.

2. The apparatus of claim 1 further comprising:

an upper tower flange attached to the tower section above the bearing tube; and, an upper bearing tube flange attached to the bearing tube.

3. The apparatus of claim 1 further comprising:

gear teeth disposed about the periphery of the lower tower flange; and, a drive pinion carried by the crane and engaging the gear teeth for rotating the crane around the tower section.

4. The apparatus of claim 1 wherein the pair of resilient strips comprise:

a first resilient strip attached to and encircling the tower section adjacent and below the upper tower flange; and, a second resilient strip attached to and encircling the tower adjacent and above the lower tower flange.

5. In an offshore jack-up platform of the type having at least three guide towers, said guide towers disposed adjacent the periphery of the platform, each tower having a central axis substantially perpendicular to said platform and having a first central bore, at least three legs, each leg received within one of said guide towers and adapted for slidable movement through said first central bore of said guide tower, drive means coupled to each of said guide towers for operably engaging each of said legs for selectively lowering each of said legs relative to the platform thereby supporting said platform from the sea bottom and for raising each of said legs thereby allowing said platform to be supported from the water surface, and a crane, the improvement comprising:

means for mounting said crane onto one of said guide towers for rotation with respect thereto, said mounting means including a tower section having a central bore on a vertical axis aligned with said first central bore of said guide tower and connected to said guide tower above said drive means, wherein said leg can slidably move through said first central bore and said tower section central bore;

a bearing tube having an upper flange and a lower flange and adapted to be mounted about the periphery of said tower section, said bearing tube supporting said crane for rotation about the periphery of said tower section; and, first bearing means interposed between an upper surface of said lower tower flange and said bearing tube for facilitating rotation of said crane around said tower section.

6. The improvement as defined in claim 5 wherein said tower section further includes:

an upper tower flange attached to the periphery of said tower section above said first bearing means and said bearing tube upper flange.

7. The improvement as defined in claim 5 including:

a drive pinion; and, said lower tower flange including gear teeth disposed around its outer periphery, said gear teeth being engaged with said drive pinion for rotating said crane mounted to said bearing tube around said tower section.

8. The improvement as defined in claim 5 wherein said first bearing means comprises:

a first resilient strip attached to and encircling the outer periphery of said tower section below said upper tower flange;

a second resilient strip attached to and encircling the outer periphery of said tower section above said lower tower flange; and, a resilient thrust segment extending radially from the outer periphery of said tower section between said lower tower flange and said lower flange of said bearing tube.

9. The improvement as defined in claim 5, further including:

a pedestal section formed having a pedestal section central bore having a vertical axis aligned with said first central bore of said guide tower and connected to said guide tower above said drive means, wherein said leg slidably moves through said first central bore and said pedestal section central bore, said pedestal section having a mounting flange connected at its upper end;

crane bearing means for supporting the crane for rotation about said vertical axis of said pedestal section;

gear means mounted with said pedestal section for engagement with said crane during rotation of said crane around the vertical axis of said pedestal section; and, a crane engine driven pinion mounted with said crane for engaging said gear means for rotation of said crane about the vertical axis of said pedestal section.

* * * * *